US009920618B2

(12) United States Patent
Stockhausen et al.

(10) Patent No.: US 9,920,618 B2
(45) Date of Patent: Mar. 20, 2018

(54) SYSTEMS AND METHODS FOR OBTAINING APPARENT FORMATION DIP USING MEASUREMENTS OF DIFFERENT EFFECTIVE PENETRATION LENGTH

(71) Applicants: Chevron U.S.A. Inc., San Ramon, CA (US); Schlumberger Technology Corporation, Sugar Land, TX (US)

(72) Inventors: Edward Stockhausen, Spring, TX (US); John C. Rasmus, Richmond, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 226 days.

(21) Appl. No.: 15/006,626

(22) Filed: Jan. 26, 2016

(65) Prior Publication Data

US 2016/0230537 A1 Aug. 11, 2016

Related U.S. Application Data

(60) Provisional application No. 62/107,976, filed on Jan. 26, 2015.

(51) Int. Cl.

| | |
|---|---|
| ***E21B 47/02*** | (2006.01) |
| ***E21B 47/022*** | (2012.01) |
| ***E21B 47/026*** | (2006.01) |

(52) U.S. Cl.

CPC ..... *E21B 47/02* (2013.01); *E21B 47/022* (2013.01); *E21B 47/026* (2013.01); *E21B 47/02208* (2013.01)

(58) Field of Classification Search

CPC ..... E21B 47/02; E21B 47/022; E21B 47/026; E21B 47/02208

USPC ..... 166/250.01

See application file for complete search history.

(56) References Cited

PUBLICATIONS

Mendoza et al., "Inversion of Sector-Based LWD Density Measurements Acquired in Laminated Sequences Penetrated by High-Angle and Horizontal Wells", Jun. 2009, SPWLA 50$^{th}$ Annual Logging Symposium, pp. 1-16.*

(Continued)

*Primary Examiner* — Hezron E Williams
*Assistant Examiner* — David Z Huang
(74) *Attorney, Agent, or Firm* — Parul P. Anderson

(57) ABSTRACT

Systems and methods for identifying formation boundaries without necessarily obtaining an azimuthal borehole image are provided. A downhole tool may be placed in a wellbore in a geological formation that has a formation boundary. First and second measurements may be obtained at a number of depths of the wellbore. The first measurement may have a first effective penetration length into the geological formation and the second measurement may have a second effective penetration length into the geological formation different from the first effective penetration length. Thus, the first measurement may detect the formation boundary at a first depth and the second measurement may detect the formation boundary at a second depth. Using a difference between the first depth and the second depth, an apparent relative angle between the wellbore and the formation boundary or an apparent formation dip, or both, may be obtained.

17 Claims, 8 Drawing Sheets

(56) References Cited

PUBLICATIONS

Uzoh et al., "Influence of Relative Dip Angle and Bed Thickness on LWD Density Images Acquired in High-Angle and Horizontal Wells", Jun. 2009, SPWLA, Petrophysics vol. 50, No. 3, pp. 269-293.*

Radtke et al., LWD Density Response to Bed Laminations in Horizontal and Vertical Wells, Petrophysics, vol. 48, No. 2, p. 76-89.

* cited by examiner

SYSTEMS AND METHODS FOR OBTAINING APPARENT FORMATION DIP USING MEASUREMENTS OF DIFFERENT EFFECTIVE PENETRATION LENGTH

CROSS-REFERENCE TO RELATED APPLICATION

The present application claims priority under 35 U.S.C. Section 119(e) to U.S. Provisional Patent Application No. 62/107,976, filed Jan. 26, 2015, and titled "Systems And Methods For Obtaining Apparent Formation Dip Using Measurements Of Different Effective Penetration Length," the entire content of which is incorporated herein by reference.

TECHNICAL FIELD

This disclosure relates to obtaining an apparent formation dip using measurements of different effective penetration length (EPL).

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

A well drilled through a geological formation may pass through numerous strata of different types of rock. The interfaces between different strata of the formation may be referred to as bed boundaries. The bed boundaries form part of the structure of the geological formation. Knowing the placement of the bed boundaries in the geological formation thus may help locate zones of interest, such as those that contain oil, gas, and/or water. One useful description of the bed boundaries is known as formation dip. Formation dip is understood as the angle between a bed boundary and a horizontal plane.

A well drilled through the formation will pass through a bed boundary at a relative angle that varies depending on the formation dip of the bed boundary. Knowing the angle of the formation bed boundaries in relation to the apparent inclination of the well, an angle which may be referred to as apparent formation dip, may be particularly useful both for drilling into the stratum of the formation where the zone of interest is located, as well as for locating the placement of the bed boundaries throughout the geological formation. Many downhole tools that can determine formation dip, however, may do so using a number of additional components that may add to the cost and complexity of the downhole tool.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to identifying formation boundaries without necessarily obtaining an azimuthal borehole image. In one example, a downhole tool may be placed in a wellbore in a geological formation that has a formation boundary. First and second measurements may be obtained at a number of depths of the wellbore. The first measurement may have a first effective penetration length into the geological formation and the second measurement may have a second effective penetration length into the geological formation different from the first effective penetration length. Thus, the first measurement may detect the formation boundary at a first depth and the second measurement may detect the formation boundary at a second depth. Using a difference between the first depth and the second depth, an apparent relative angle between the wellbore and the formation boundary or an apparent formation dip, or both, may be obtained.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
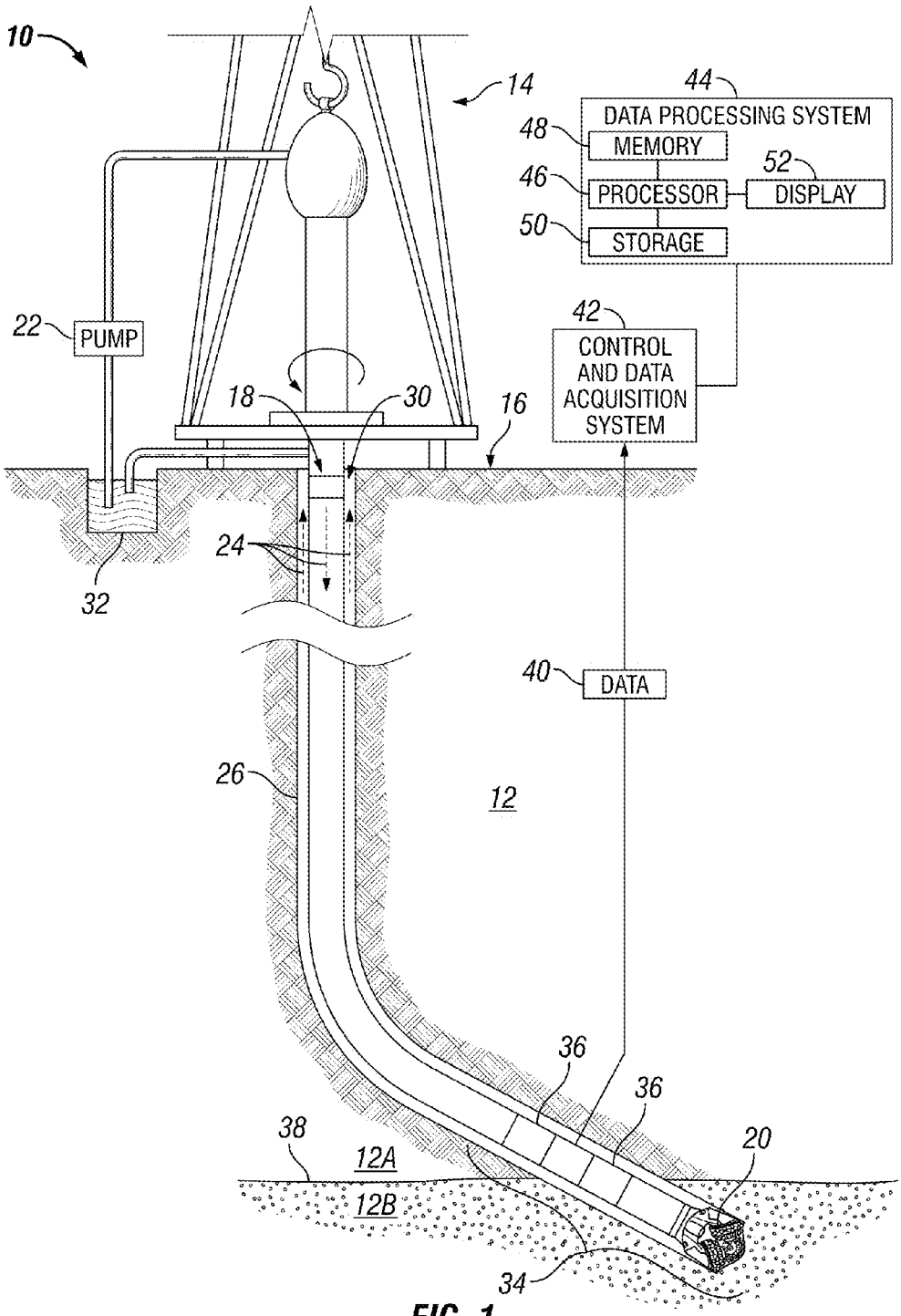
FIG. 1 is a schematic diagram of a drilling system that includes a downhole tool with two effective penetration lengths (EPLs), which can be used to identify an apparent formation dip, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

When a well is drilled through a geological formation, the well may pass through numerous strata of different types of rock. Each of these may be referred to as a formation bed, and the interface between different beds may be referred to as a bed boundary. The bed boundaries form part of the structure of the geological formation. Knowing the placement of the bed boundaries in the geological formation thus may help locate zones of interest, such as those that contain oil, gas, and/or water. One useful description of the bed boundaries is known as formation dip. Formation dip is understood as the angle between a bed boundary and a horizontal plane.

Measuring the properties of the geological formation may indicate where bed boundaries generally occur. In this disclosure, two measurements of a property of the geological formation, taken to have different effective penetration lengths (EPLs) into the geological formation, may be used to ascertain not just the general location of a bed boundary, but an apparent formation dip of the bed boundary as well. A variety of downhole tools may be used to obtain such measurements. Suitable measurements may include gamma-gamma density, neutron-gamma density, resistivity, neutron porosity, lithology, or hydrogen index, to name just a few. Indeed, any suitable measurements that can be obtained at different EPLs may be used. Based on a distance between a first depth in the well, where a first measurement at a first EPL detects a bed boundary, and a second depth in the well, where a second measurement at a second EPL detects the bed boundary, a relative angle θ between the well and the bed boundary may be determined. Using the relative angle θ and the inclination of the well, an apparent formation dip may be ascertained. It should be appreciated that the different EPLs may be fixed or variable.

With this in mind, FIG. 1 illustrates a drilling system 10 that uses a downhole tool to obtain two measurements of different effective penetration lengths (EPLs), which may be used to ascertain an apparent formation dip of a bed boundary. It should be appreciated that, while the measurements are described as obtained using a drilling system, any suitable tools having any suitable means of conveyance may be used to obtain the two measurements of the different EPLs.

The drilling system 10 of FIG. 1 may be used to drill a well into a geological formation 12. A drilling rig 14 at the surface 16 may rotate a drill string 18 having a drill bit 20 at its lower end. As the drill bit 20 is rotated, a drilling fluid pump 22 is used to pump drilling fluid 23, commonly referred to as "mud" or "drilling mud," downward through the center of the drill string 18 in the direction of the arrow to the drill bit 20. The drilling fluid 23, which is used to cool and lubricate the drill bit 20, exits the drill string 18 through the drill bit 20. The drilling fluid 23 then carries drill cuttings away from the bottom of a wellbore 26 as it flows back to the surface 16, as shown by the arrows through an annulus 30 between the drill string 18 and the formation 12. However, as described above, as the drilling fluid 23 flows through the annulus 30 between the drill string 18 and the formation 12, the drilling mud 23 may begin to invade and mix with the fluids stored in the formation, which may be referred to as formation fluid (e.g., natural gas or oil). At the surface 16, return drilling fluid 24 is filtered and conveyed back to a mud pit 32 for reuse.

As illustrated in FIG. 1, the lower end of the drill string 18 includes a bottom-hole assembly (BHA) 34 that may include the drill bit 20 along with various downhole tools 36. The downhole tools 36 may collect a variety of information relating to the geological formation 12 and/or the state of drilling of the well. For instance, a measurement-while-drilling (MWD) tool 36 may measure certain drilling parameters, such as the temperature, pressure, orientation of the drilling tool, and so forth. Likewise, a logging-while-drilling (LWD) tool 36 may measure the physical properties of the geological formation 12, such as density, porosity, resistivity, lithology, and so forth.

The BHA 34 is shown drilling a partially horizontal well through two different beds of the formation 12, illustrated here as 12A and 12B. A formation boundary 38 represents the interface between these different strata of the formation 12. The wellbore 26 intersects the formation boundary 38 at a relative angle θ. The relative angle theta (θ) may be determined based on any suitable measurements of the formation 12 by one of the downhole tools 36 that investigates the formation 12 at different effective penetration lengths (EPLs), as will be described further below. Measurements with different EPLs will detect changes in the formation indicative of the formation boundary 38 at different depths in the wellbore 26. As discussed below, this information may be used to determine the relative angle θ and/or formation dip of the formation boundary, even without a borehole image (e.g., an azimuthal density image). Thus, even relatively non-complex measurements (of different EPL) may be used.

The downhole tool 36 that makes these measurements may transmit the measurements to the surface as data 40 that may be stored and processed in the BHA 34 or, as illustrated in FIG. 1, may be sent to the surface for processing. The data 40 may be sent via a control and data acquisition system 42 to a data processing system 44. The control and data acquisition system 42 may receive the data 40 in any suitable way. In one example, the control and data acquisition system 42 may transfer the data 40 via electrical signals pulsed through the geological formation 12 or via mud pulse telemetry using the drilling fluid 24. In another example, the data 40 may be retrieved directly from the downhole tool 36 upon return to the surface.

The data processing system 44 may include a processor 46, memory 48, storage 50, and/or a display 52. The data processing system 44 may use the data 40 to determine various properties of the well using any suitable techniques. To process the data 40, the processor 46 may execute instructions stored in the memory 48 and/or storage 50. As such, the memory 48 and/or the storage 50 of the data processing system 44 may be any suitable article of manufacture that can store the instructions. The memory 46 and/or the storage 50 may be ROM memory, random-access memory (RAM), flash memory, an optical storage medium, or a hard disk drive, to name a few examples. The display 52 may be any suitable electronic display that can display the logs and/or other information relating to properties of the well as measured by the downhole tool 36. It should be appreciated that, although the data processing system 44 is shown by way of example as being located at the surface, the data processing system 44 may be located in the BHA 34. In such embodiments, some of the data 40 may be processed and stored downhole, while some of the data 40 may be sent to the surface in real time. This may be the case particularly in LWD, where a limited amount of the data 40 may be transmitted to the surface during drilling or reaming operations.

Figure 2:
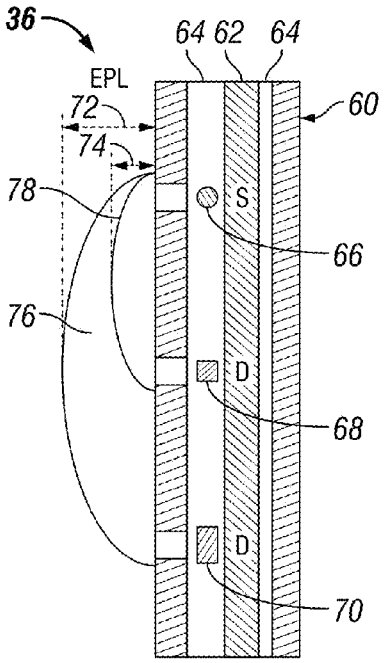
FIG. 2 is a schematic view of an example of the downhole tool that obtains a first measurement at a first EPL and a second measurement at a second, deeper EPL, in accordance with an embodiment.
Figure 3:
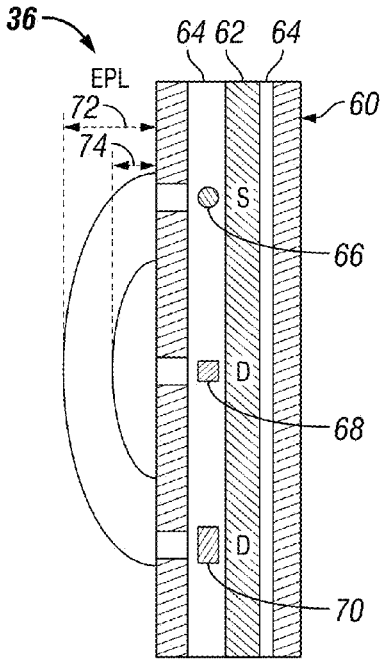
FIG. 3 is a schematic view of the downhole tool in which the first and second measurement have been depth-matched, in accordance with an embodiment.

Any suitable downhole tool 36 having at least two effective penetration lengths (EPLs) may be used. An example downhole tool 36 appears in FIGS. 2 and 3. Although FIGS. 2 and 3 represent a downhole tool 36 in a logging-while-drilling (LWD) configuration, any suitable means of conveyance may be used (e.g., wireline, slickline, coiled tubing, and so forth). In the examples shown in FIGS. 2 and 3, the downhole tool 36 includes an outer housing 60 containing a mud channel 64 and an inner housing 62 containing measurement components. The measurement components may include a signal source 66, a near-spaced signal detector 68, and a far-spaced signal detector 70.

As shown in FIG. 2, the far-spaced detector 70 may have a deep effective penetration length (deep EPL) 72, while the near-spaced signal detector 68 may have a shallow effective penetration length (shallow EPL) 74. This is because a first portion 76 of a signal emitted by the signal source 66 travels deeper into the surrounding formation 12 on its way to the far-spaced signal detector 70. The near-spaced signal detector 68 has the shallow EPL 74 because a second portion 78 of the signal emitted by the signal source 66 does not travel as deeply into the surrounding formation on its way to the near-spaced signal detector 68.

As noted above, the type of measurement obtained by the downhole tool 36 may be any suitable measurement with two different EPLs. As such, in one example, the signal source 66 of the downhole tool 36 is a neutron source (e.g., a radioisotopic source of neutrons or an electronic neutron generator, such the Minitron™ by Schlumberger Technology Corporation). The near-spaced signal detector 68 and the far-spaced signal detector 70 may be neutron detectors that detect neutrons that return to the downhole tool 36. Additionally or alternatively, the near-spaced signal detector 68 and the far-spaced signal detector 70 may be gamma-ray detectors that detect gamma-rays that are produced when the neutrons are emitted into the formation 12.

In another example, the downhole tool 36 may be a photonic measurement tool, in which the signal source 66 is a source of photons that can penetrate into the formation 12, such as gamma-rays or x-rays. The signal source 66 may be a radioisotopic gamma-ray source, an electronic gamma-ray source, a radioisotopic x-ray source, or an electronic x-ray source, to name a few examples. The near-spaced signal detector 68 and the far-spaced signal detector 70 may be photonic detectors (e.g., scintillation detectors) that detect the photons after the photons have interacted with the formation 12 and return to the downhole tool 36.

In other examples, the downhole tool 36 may be an electromagnetic measurement device that emits an electromagnetic signal (e.g., current, electromagnetic induction, or radio frequency (FR)), or a nuclear magnetic resonance (NMR) measurement. The particular measurements mentioned here, however, are meant to be examples and are not intended to be exhaustive. Indeed as noted above, the systems and methods of this disclosure may employ any suitable measurements that include at least two EPLs (e.g., the deep EPL 72 and the shallow EPL 74). In fact, the two measurements of different EPL may even be of two different respective types or even from two different downhole tools 36 (e.g., the first measurement may be a neutron measurement of a first EPL and the second may be a gamma-ray measurement of a second EPL, or the first measurement may be an electromagnetic measurement of a first EPL and the second measurement may be a radiation-based measurement of a second EPL, to name but a few examples).

To more easily identify the formation boundary 38 at the deep EPL 72 and the shallow EPL 74, the measurements obtained by the near-spaced signal detector 68 and the far-spaced signal detector 70 may be aligned. In the example of FIG. 2, the measurement from the near-spaced signal detector 68 is not aligned with that of the far-spaced signal detector 70. FIG. 3 shows the effect of shifting the near-spaced signal detector 68 data to correspond to the same sample point along a depth of the wellbore 18. The data obtained by the near-spaced signal detector 68 and the far-spaced signal detector 70 may be processed in any other suitable way to provide, for instance, resolution matching and/or corrections for borehole effects. Moreover, while the discussion below describes using shifted data, such that the data from the near-spaced signal detector 68 and far-spaced signal detector 70 relate to the same measure point in a depth of the wellbore 18, other embodiments may use unshifted data. The unaligned nature of the unshifted data may be accounted for by modifying the process discussed below in any suitable way (e.g., by modifying the equations to align the measurements to the same depths).

Figure 4:
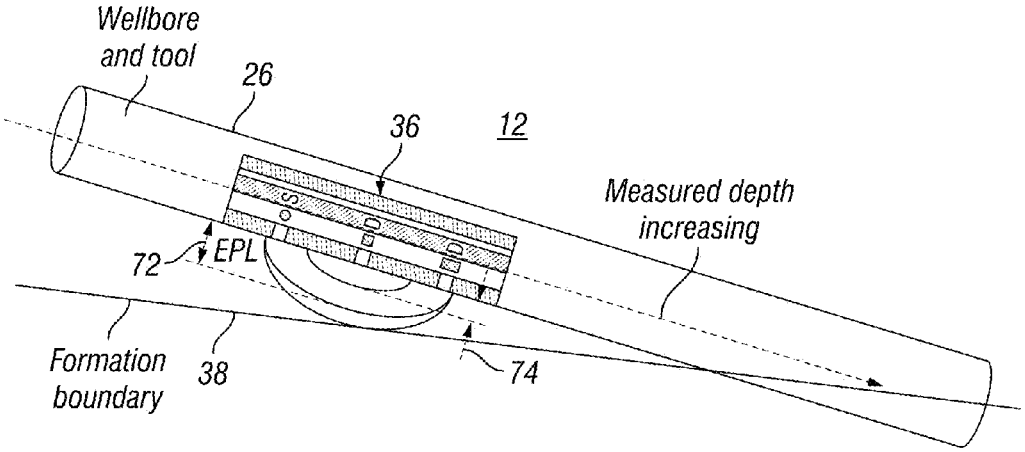
FIGS. 4-6 are schematic views of the downhole tool moving down-section through a partially horizontal well past a bed boundary, particularly illustrating that the second, deeper measurement may detect the bed boundary before the first, shallower measurement under these circumstances, in accordance with an embodiment.
Figure 5:
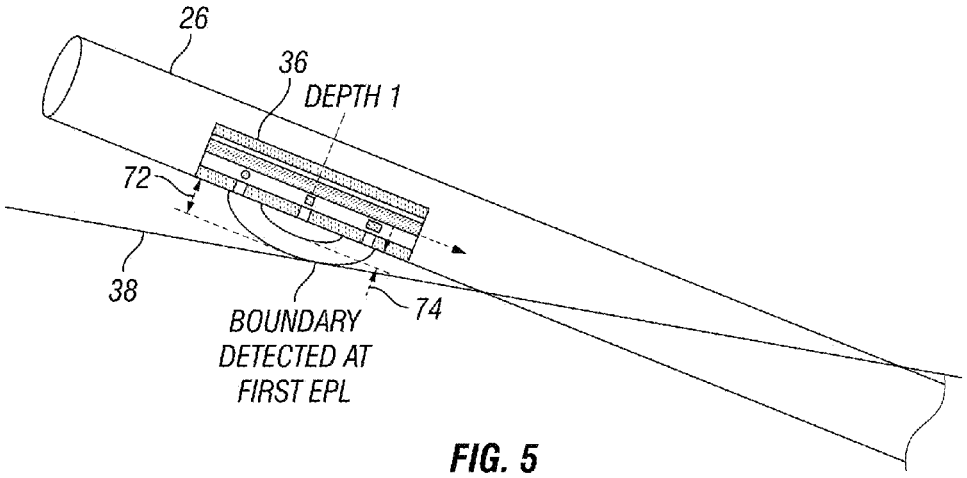
Figure 6:
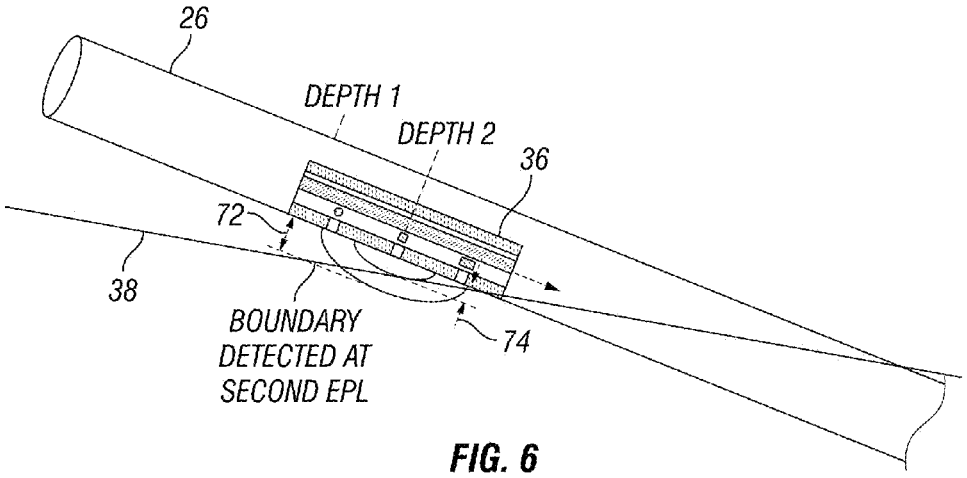

A relationship between the wellbore 26 and the formation boundary 38 may be identified by observing differences between the depth where the deep EPL 72 crosses the formation boundary 38 and the depth where the shallow EPL 74 crosses the formation boundary 38. FIGS. 4-6 show the movement of the downhole tool 36 through the wellbore 26, and how different measurements that may be obtained that identify the formation boundary 38.

For instance, in FIG. 4, the wellbore 26 is shown to contain the downhole tool 36. The downhole tool 36 is shown to be moving with increasing measured depth toward the formation boundary 38 in the wellbore 26. In FIG. 4, neither the deep EPL 72 nor the shallow EPL 74 has crossed the formation boundary 38.

In FIG. 5, the downhole tool 36 is shown to have traversed the wellbore 26 far enough that the deep EPL 72 measurement indicates that the formation boundary 38 is detected in that measurement. That is, the deep EPL 72 measurement may be said to "see" the formation boundary 38. However, since the shallow EPL 72 measurement is detecting parts of the formation 12 above the formation boundary 38, the formation boundary 38 is not "seen" by the shallow EPL 72 measurement. In the example of FIG. 5, the depth at which the deep EPL 72 first detects the formation boundary 38 is referred to as Depth 1. In FIG. 6, the downhole tool 36 has further traversed the borehole 26 to a second depth, referred to as Depth 2, where the shallow EPL 74 first begins to cross the formation boundary 38.

Figure 8:
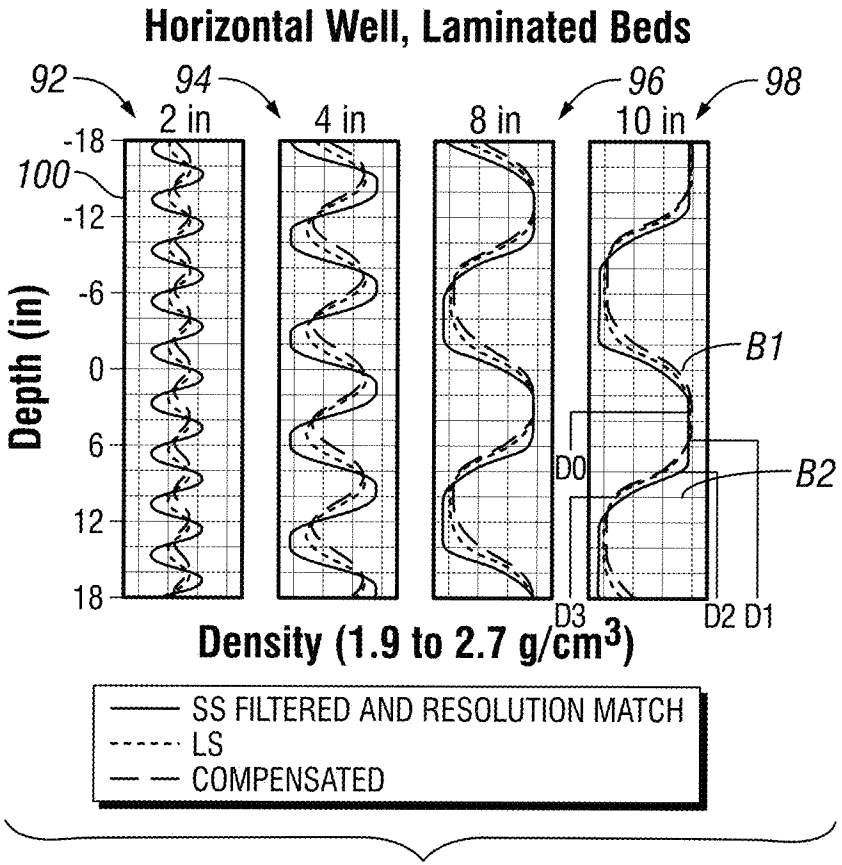
FIG. 8 is a set of plots illustrating density measurements of different ELPs over various depths of a formation with laminated beds, in accordance with an embodiment.
Figure 7:
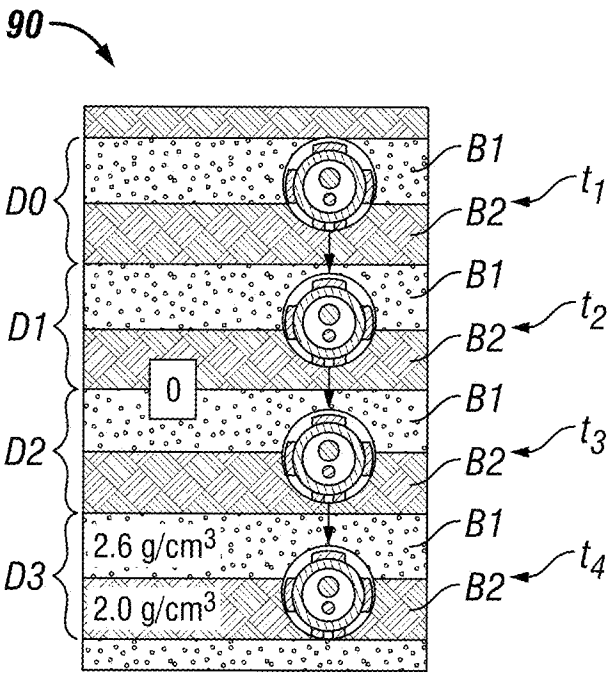
FIG. 7 is a diagram showing cross-sectional views of the downhole tool in relation to a bed boundary as the tool traverses the well at various depths, in accordance with an embodiment.

As may be appreciated from FIGS. 5 and 6, these measurements of different EPL may identify formation boundaries 38. One example of this is through laminated beds, as shown in FIGS. 7 and 8. These figures illustrate formation data that has been modeled as having been obtained by a logging-while-drilling (LWD) tool using Monte Carlo nuclear particle (MCNP) modeling code. FIG. 7 illustrates the movement of the downhole tool 36 at snapshots of four different depths through the wellbore 26. The plots of FIG. 8 correspond onto the modeled movement of the downhole tool 36 as shown in FIG. 7. A diagram 90 of FIG. 7 illustrates that, over depths D0, D1, D2, and D3, the downhole tool 36 progressively approaches the formation boundaries B1 and B2. The downhole tool 36 reaches depths D0, D1, D2, and D3 at times $t_1$, $t_2$, $t_3$, and $t_4$, respectively.

Plots 92, 94, 96, and 98 of FIG. 8 correspond to density measurements modeled as having been obtained by the downhole tool 36 moving through the beds (e.g., B1 and B2) of a laminated the manner illustrated in FIG. 7. In particular, the plots 92, 94, 96, and 98 illustrate density measurements obtained over a number of depths 100 for which laminated beds are 2 inches, 4 inches, 8 inches, or 10 inches, respectively. In plot 98, examples of measurements that represent those taken at depths D0, D1, D2, and D3 are noted.

As may be appreciated, in FIGS. 7 and 8, the deep EPL 72 first senses the formation boundary 38 (e.g., at an interface between B1 and B2), followed by the shallow EPL 74, creating an apparent depth offset between them. By convention, this depth offset and the relative angle theta (θ) between the wellbore 26 and the formation boundary 38 is negative. When drilling up-section with the downhole tool 36 facing down, the near-spaced signal detector 68 will sense the formation boundary 38 first, while the far-spaced signal detector 70 will sense the formation boundary 38 at a deeper measured depth. By convention, the corresponding depth offset from up-section measurements and the relative angle theta (θ) between the wellbore 26 and formation 12 is positive.

If a depth where the formation boundary 38 crosses the wellbore 26 can be identified, a single EPL may be used to identify the relative angle theta (θ). For example, as shown in a in FIG. 9, there is a relationship between the relative angle theta (θ), the effective penetration length (EPL), and a measured depth difference (X). The measured depth difference (X) represents a difference between a depth where the formation boundary 38 crosses the wellbore 26 and a measured depth at which a detector measurement first detects the formation boundary 38. The EPL may be fixed and constant or may be variable, depending on the physics of the measurement. This disclosure may use measurements of a fixed or a variable EPL. The relationship between the relative angle theta (θ), the effective penetration length (EPL), and a measured depth difference (X) may be expressed according to the following equation:

$$X=([EPL/\tan(theta)])*\cos(180-TF) \quad \text{EQ 1,}$$

where TF represents a toolface angle term. The toolface angle (TF) describes the number of degrees in a clockwise direction, looking downhole from the top of the wellbore 26, to the azimuth of the downhole tool 36. When the downhole tool 36 is a wireline tool, the toolface angle may be very close to 180 degrees. This is because the weight of the housing holding the detectors 68 and 70 may be in the heaviest section of downhole tool 36, and the downhole tool 36 may ride along the bottom of the wellbore 26. If the downhole tool 36 rides up the side of the wellbore 26, the cos(180−TF) term corrects for this effect. If the orientation is toward the top of the wellbore 26, EQ. 1 may properly account for this.

Figure 10:
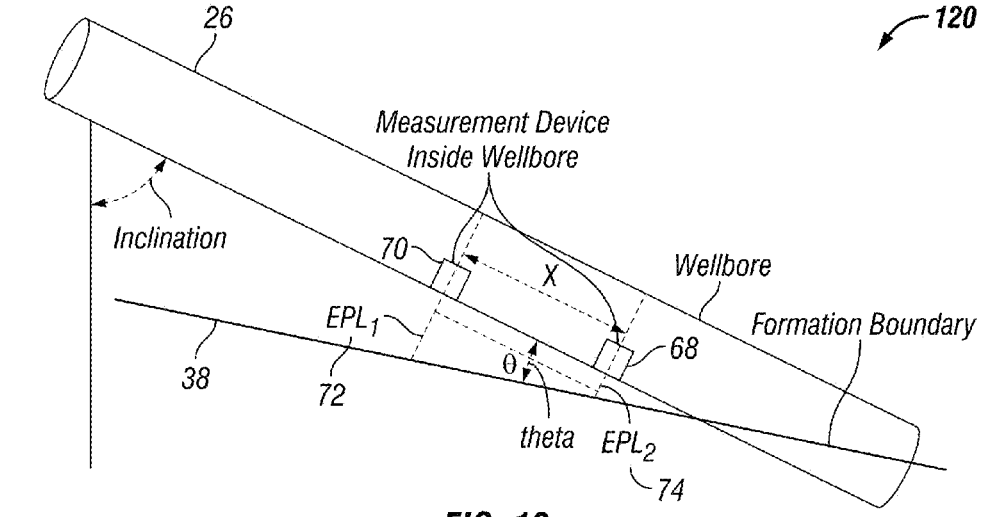
FIG. 10 is an illustration of a determination of a relative angle between a partially horizontal well that passes through a bed boundary using two measurements of different EPLs without other knowledge of the depth where the well passes through the bed boundary, in accordance with an embodiment.

But EQ. 1 may not be practical unless there is a sensing device that can determine the measured depth at which the formation boundary 38 intersects the wellbore 26 wall. Lacking this type of measurement, two or more measurements of different EPL may be used (e.g., as may be obtained by the example of the downhole tool 36 shown in FIGS. 2 and 3). Specifically, the difference in measured depth associated with the distance X can be computed as a function of the EPL for each using EQ. 1. For example, turning to FIG. 10, the difference in measured depth (ΔX) between the near-spaced signal detector 68 and the far-spaced signal detector 70 (or short-spacing density and long spacing corrected compensated density) may be computed as the difference in measured depth ($X_{SS}$) for the near-spaced signal detector 68 minus the measured depth ($X_{COMP}$) computed for the far-spaced signal detector 70. The equation to compute the relative angle theta (θ), when using two or more detectors of different EPL, can be seen in FIG. 10. The relationship may be written as:

$$\tan(theta)=(EPL_1-EPL_2)/((\Delta X)/(\cos(180-TF))) \quad \text{EQ. 1a,}$$

where $EPL_1$ represents a first effective penetration length of the first measurement and $EPL_2$ represents a second effective penetration length of the second measurement, and ΔX represents the difference between the first depth where the deep EPL 72 first obtains a measurement that can be used to identify the formation boundary 38 and the second depth where the deep EPL 72 and the shallow EPL 74 first obtains a measurement that can be used to identify the formation boundary 38.

Figure 11:
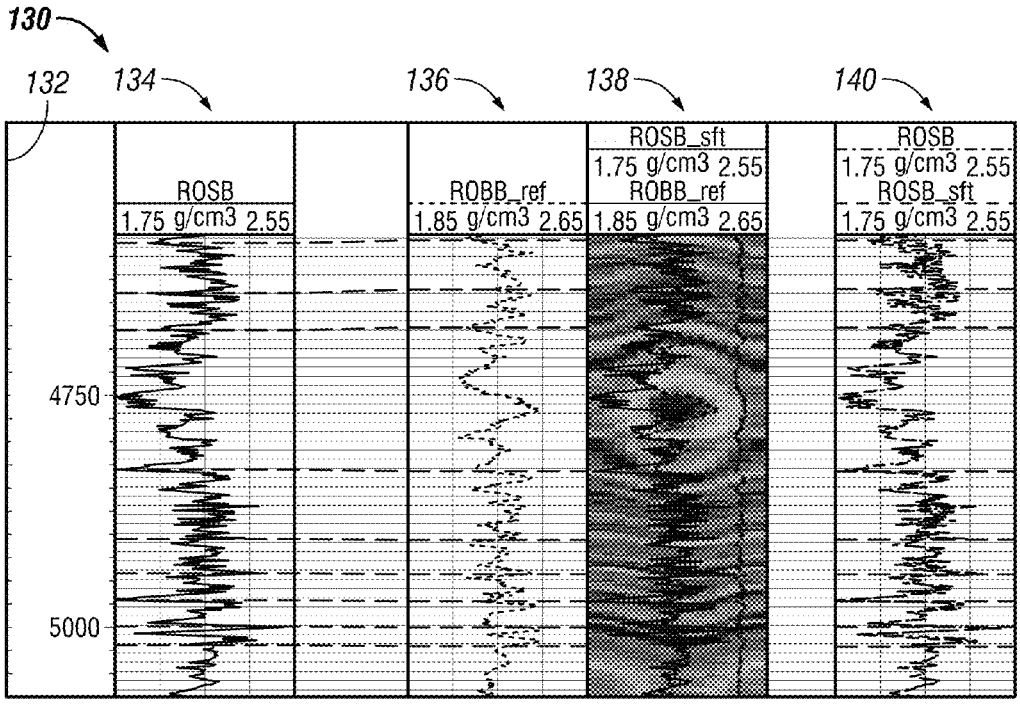
FIG. 11 is a well log in which two measurements of different EPLs have been correlated in depth via depth-matching, in accordance with an embodiment.
Figure 12:
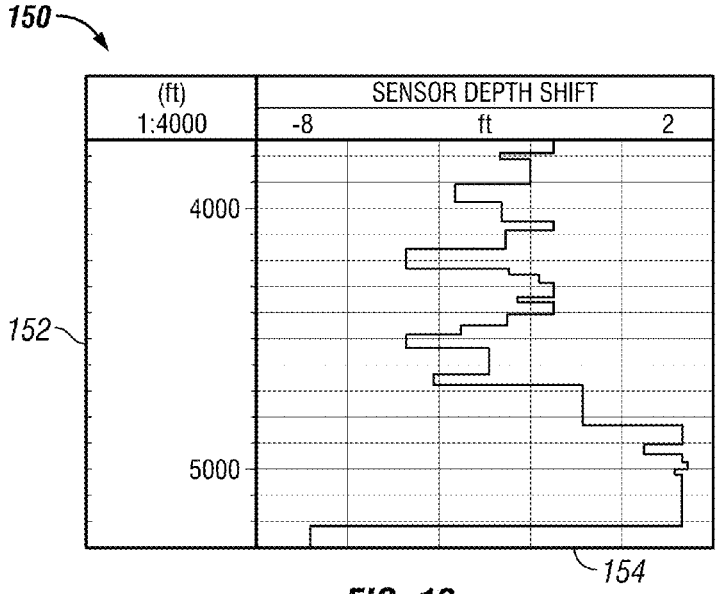
FIG. 12 is a plot of an amount of depth shift (ΔX) associated with measurements of different EPL through depths of the well through a laminated formation, in accordance with an embodiment.

Using EQ. 1a and the ability to determine (ΔX) by depth-matching the near-spaced signal detector 68 to the far-spaced signal detector 70, the relative angle theta may be calculated. FIGS. 11 and 12 represent the correlation of the near-spaced signal detector 68 to the far-spaced signal detector 70. In particular, FIG. 11 represents a well log 130 over certain depths 132. A first plot 134 represents a response of the near-spaced signal detector 68, a plot 136 represents a response of the far-spaced signal detector 70, a third plot 138 represents these measurements overlaid on an azimuthal measurement of the wellbore 26, and a plot 140 represents a depth-matched response of the near-spaced signal detector 68. The response of the near-spaced signal detector 68 may be depth-matched to the far-spaced signal detector 70 using any suitable technique. It should be appreciated that azimuthal data may or may not be used.

Obtaining the depth-matched response of the near-spaced signal detector 68 may entail depth differences being computed between the responses of the near-spaced signal detector 68 and the far-spaced signal detector 70. A plot 150 of such differences appears in FIG. 12. In the plot 150, for a series of depths 152 (e.g., the same depths as the depths 132 of the well log 130 of FIG. 11), a sensor depth shift is represented along an abscissa 154 (e.g., between −8 and +2 feet). As seen in FIG. 12, the sensor depth shift values may be positive or negative. Here, the convention mentioned earlier, where drilling down-section will have a negative depth shift between sensors resulting in a negative theta (and vice-versa), is used in FIG. 12.

Figure 13:
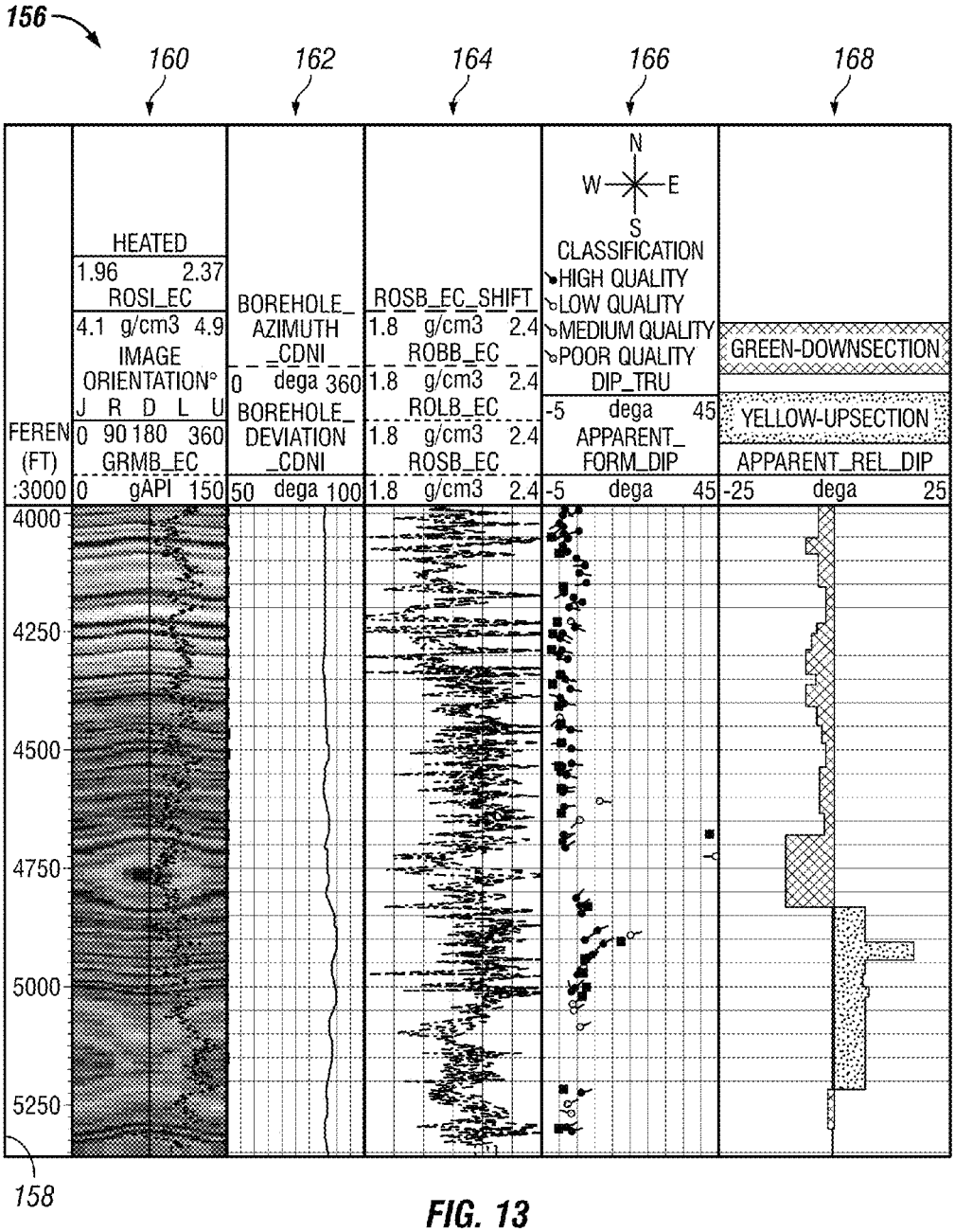
FIG. 13 is a resulting well log that illustrates apparent relative formation dip, in accordance with an embodiment.

As seen in FIG. 13, the sensor depth shift shown in FIG. 12 may be used to generate a well log 156. The example well log 156 includes a first track 158, a second track 160, a third track 162, a fourth track 164, a fifth track 166, and a sixth track 168. The first track 158 shows the depth in relation to the information contained in the other tracks. The second track 160 and the third track 162, representing a borehole density measurement and borehole azimuth, respectively, are not used by currently described systems and methods, but are shown here for comparison with the answers of the subsequent tracks. In particular, the sixth track 168 shows apparent relative dip (theta), including up-section and/or down-section flagging, determined according to the methods and systems of this disclosure using the measurements shown in the fourth track 164. The fifth track 166 shows apparent formation dip in the azimuth of the wellbore 26. The fifth track 166 also shows a comparison between the apparent formation dip and a true formation dip computed from a density image of the second track 160. As noted above, the density image of the second track 160 is not used according to the current systems and methods, but rather is shown to illustrate that the systems and methods of this disclosure are very similar to measurements made from more complex borehole image measurements, despite involving merely any two suitable measurements of different EPL.

Figure 14:
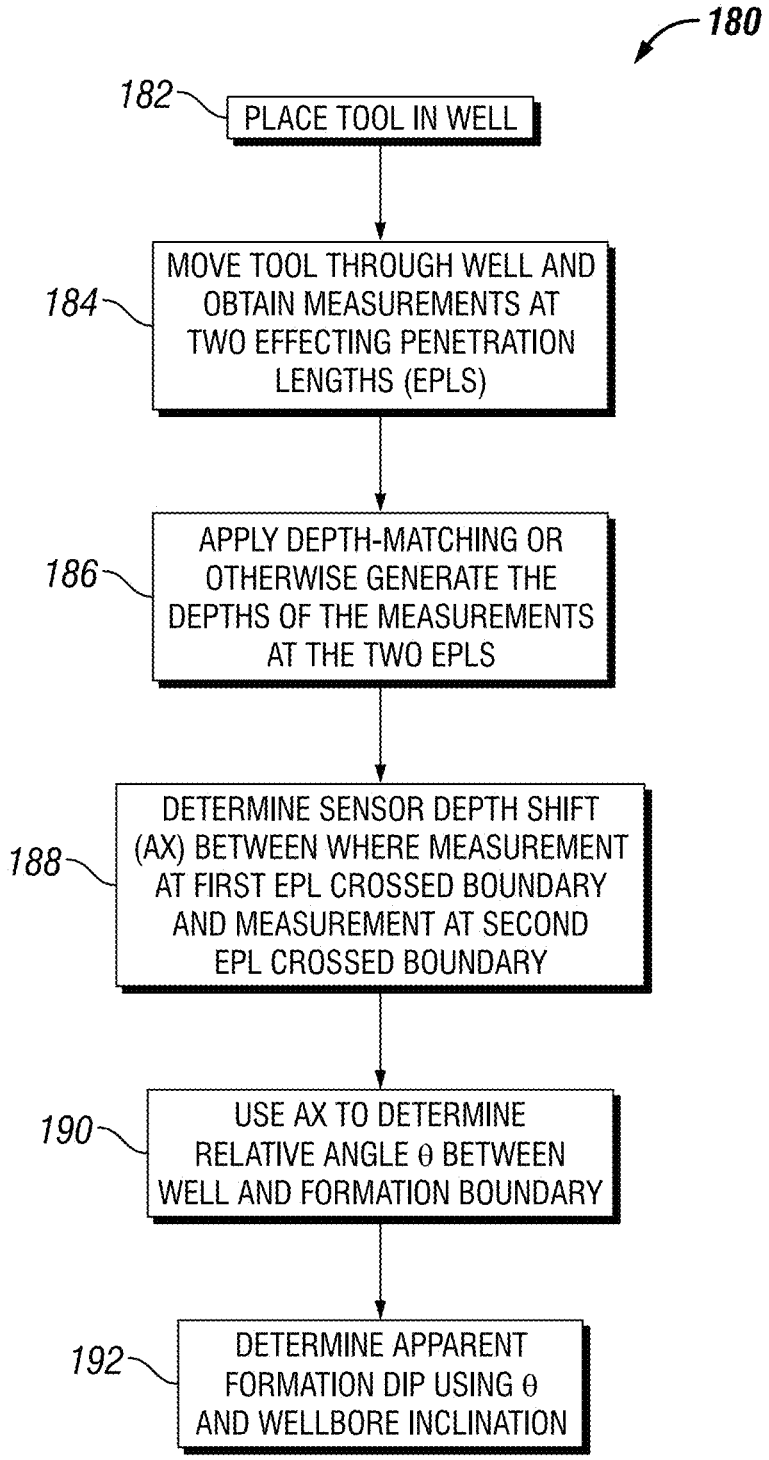
FIG. 14 is a flowchart of a method for determining apparent formation dip using two measurements of different EPLs, in accordance with an embodiment.

FIG. 14 is a flowchart 180 illustrating a method according to this disclosure. The downhole tool 36 may be placed in the wellbore 26 in an LWD or other conveyance (block 182). The downhole tool 36 may be moved through the wellbore 26 and measurements of the geological formation 12 of at least two different EPLs may be obtained (block 184). Depth-matching or any other suitable correlation between the measurements of different EPL may be used to cause the measurements of different EPL to line up to the same depth, as mentioned further above (block 186).

Using any suitable technique (e.g., EQ. 1a noted above), sensor depth shift (ΔX) between a depth where a measurement of the first EPL detected the formation boundary 38 and a depth where a measurement of the second EPL detected the formation boundary 38 may be obtained (block 188). It may be appreciated that the apparent depth shift computed in the azimuth of the wellbore 26 may take into account the orientation of the downhole tool 36 sensor relative to the top of the wellbore 26. This measured angle is toolface angle (TF), and may be accounted for by the following relationship describing apparent depth shift:

app_depth_shift=SensorDepthShift/(cos(radians(180−TF))) Eq 2.

The difference in the EPL of the two detector measurements (such as gamma-gamma density measurements) may be computed as:

EPL_difference=(EPL_short_spacing−EPL_long_spacing) Eq 3.

For compensated gamma-gamma density measurements, this may be:

EPL_difference=(EPL_short_spacing−EPL_compensated) Eq. 4; or

EPL_difference=(EPL_short spacing−EPL_long spacing) Eq. 4a.

Figure 9:
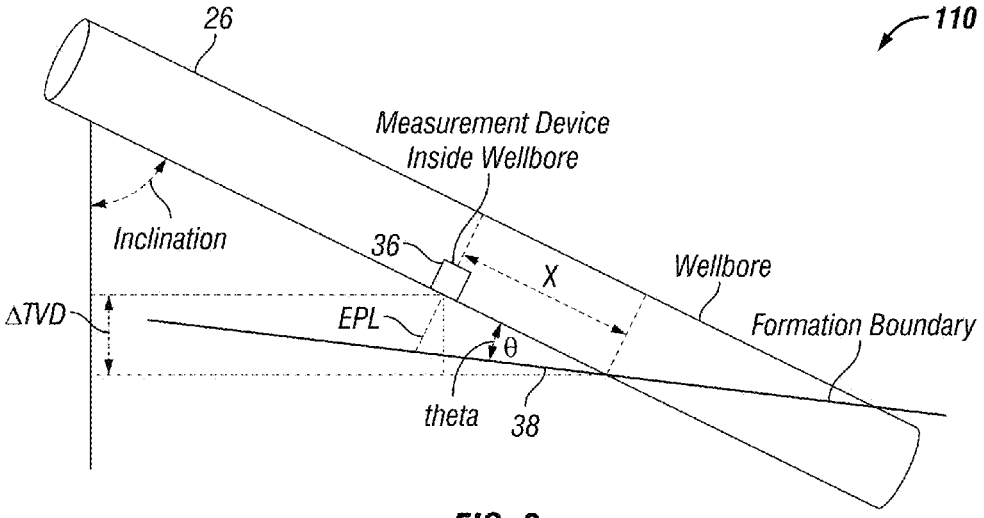
FIG. 9 is an illustration of a determination of a relative angle between a partially horizontal well that passes through a bed boundary using a single measurement and a previously known depth where the well passes through the bed boundary, in accordance with an embodiment.

The term EPL_difference refers to the difference between the first EPL (e.g., short-spacing or long-spacing) and the second EPL (e.g., short-spacing or long-spacing). Using the information obtained above, relative angle theta may be obtained (block 190 of the flowchart 180). The apparent relative angle theta between the borehole and the formation boundary (as shown in FIG. 9) may be described as:

Theta=arctan(EPL_difference/app_depth_shift) Eq. 5.

Positive values of theta indicate the wellbore is drilling "down-section" relative to the geological strata, while negative values indicate the wellbore is drilling "up-section" relative to the geological strata.

The apparent formation dip in the azimuth of the wellbore may be computed using the relative angle theta and the wellbore inclination (block 192). One way of doing so appears below:

Apparent_Formation_Dip=90−wellbore Inclination+theta Eq. 6.

It should be appreciated that the relative angle theta and/or the apparent formation may be obtained using any suitable measurements of different EPL, whether compensated or not, as long as the different measurements may be used to detect the formation boundary 38 at different depths. Moreover, these techniques may be employed without an azimuthal measurement. In some embodiments, however, an azimuthal measurement may be used as a check to verify the correctness of the apparent formation dip and/or apparent relative angle theta obtained according to the techniques above, or vice versa.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

placing a downhole tool in a wellbore in a geological formation that has a formation boundary;

obtaining a first non-azimuthal measurement and a second non-azimuthal measurement of the geological formation using the downhole tool at a plurality of depths of the wellbore, wherein the first measurement has a first effective penetration length into the geological formation and the second measurement has a second effective penetration length into the geological formation different from the first effective penetration length, such that the first measurement detects the formation boundary at a first depth and the second measurement detects the formation boundary at a second depth; and determining an apparent relative angle between the wellbore and the formation boundary or an apparent formation dip, or both, using a difference between the first depth and the second depth.

2. The method of claim 1, wherein the first measurement and the second measurement comprise acoustic measurements, resistivity measurements, photonic measurements, nuclear-radiation-based measurements, electromagnetic measurements, nuclear magnetic resonance measurements, or any combination thereof.

3. The method of claim 1, wherein the first measurement and the second measurement are depth-matched to one another.

4. The method of claim 1, wherein the first measurement and the second measurement are respectively obtained by measuring a first response from a first sensor due to a signal emitted by a common signal source and measuring a second response from a second sensor due to the signal emitted by the common signal source, wherein the signal has different depths of investigation into the geological formation from the perspective of the first sensor and the second sensor.

5. The method of claim 1, wherein the apparent relative angle between the wellbore and the formation boundary or an apparent formation dip, or both, are determined without any azimuthal wellbore measurements.

6. The method of claim 1, wherein the apparent relative angle between the wellbore and the formation boundary is determined in accordance with the following relationship:

$$\tan(\text{theta})=(EPL_1-EPL_2)/((\Delta X)/(\cos(180-TF)));$$

where theta represents the apparent relative angle, $EPL_1$ represents the first effective penetration length, $EPL_2$ represents the second effective penetration length, $\Delta X$ represents a difference between the first depth and the second depth, and TF represents a toolface angle of the downhole tool.

7. The method of claim 6, wherein the apparent formation dip is determined in accordance with the following relationship:

$$\text{Apparent_Formation_Dip}=90-\text{wellbore Inclination}+\text{theta}$$

where Apparent_Formation_Dip represents the apparent formation dip, wellbore inclination represents an inclination of the wellbore, and theta represents the apparent relative angle.

8. The method of claim 1, comprising generating a well log comprising an up-section flag or a down-section flag, or both, using the apparent relative angle between the wellbore and the formation boundary or the apparent formation dip, or both.

9. The method of claim 1, comprising using the apparent relative angle between the wellbore and the formation boundary or the apparent formation dip, or both, to check an alternate computation of formation dip or relative angle, or both, that is obtained using a different determination that the apparent relative angle between the wellbore and the formation boundary or the apparent formation dip, or both.

10. The method of claim 1, wherein the alternate computation of formation dip or relative angle, or both, is obtained based on an azimuthal borehole image.

11. The method of claim 1, wherein the apparent relative angle between the wellbore and the formation boundary is determined in accordance with the following relationship:

$$\text{Theta}=\arctan(\text{EPL_difference}/\text{app_depth_shift}),$$

where theta represents the apparent relative angle, EPL_difference represents a difference between the first and second effective penetration lengths, and app_depth_shift represents an apparent depth shift based on the difference between the first depth and the second depth shift and a toolface angle of the downhole tool.

12. A system comprising:

a downhole tool configured to be moved through a wellbore in a geological formation comprising a formation boundary between two geological strata, wherein the downhole tool is configured to obtain:

a first non-azimuthal measurement of a first effective penetration length into the geological formation; and a second non-azimuthal measurement of a second effective penetration length into the geological formation, wherein the second effective penetration length is different from the first effective penetration length;

wherein the first measurement comprises values indicative of the formation boundary at a first depth and the second measurement comprises values indicative of the formation boundary at a second depth;

a data processing system configured to identify whether the wellbore is down-section relative to the geological strata or up-section relative to the geological strata using a difference between the first depth and the second depth.

13. The system of claim 12, wherein the downhole tool comprises a logging-while-drilling tool.

14. The system of claim 12, wherein the downhole tool comprises an acoustic tool, a resistivity tool, a photonic-radiation-based tool, a nuclear-radiation-based tool, an electromagnetic tool, a nuclear magnetic resonance tool, or any combination thereof.

15. The system of claim 12, wherein the data processing system is configured to determine an apparent relative angle between the wellbore and the formation boundary using the difference between the first depth and the second depth.

16. The system of claim 15, wherein the data processing system is configured to use the apparent relative angle to identify whether the wellbore is down-section relative to the geological strata or up-section relative to the geological strata.

17. The system of claim 12, wherein the data processing system is configured to determine an apparent formation dip using the difference between the first depth and the second depth.

* * * * *